US006060831A

United States Patent [19]

Roozekrans et al.

[11] Patent Number: 6,060,831

[45] Date of Patent: May 9, 2000

[54] DISCHARGE LAMP WITH SPECIFIC FILL AND LUMINESCENT LAYERS

[75] Inventors: Christianus J. Roozekrans, Eindhoven; Dick Van der Voort, Eindhoven; Franciscus A. S. Ligthart, deceased, late of Eindhoven, Valkenswaard, all of Netherlands, by Henricus J. Kunnen, legal representative

[73] Assignee: U.S. Philips Corporation, New York, N.Y.

[21] Appl. No.: 09/090,105

[22] Filed: Jun. 3, 1998

[30] Foreign Application Priority Data

Jun. 11, 1997 [EP] European Pat. Off. ..... 97201769

[51] Int. Cl.[7] ..... H01J 61/20

[52] U.S. Cl. ..... 313/642; 313/635

[58] Field of Search ..... 313/486, 483, 313/571, 635, 642

[56] References Cited

U.S. PATENT DOCUMENTS 4,559,470 12/1985 Murakami et al. ..... 313/487
4,800,319 1/1989 Van Kemenade et al. ..... 313/487
5,387,837 2/1995 Roelevink et al. ..... 343/484
5,825,125 10/1998 Ligthart et al. ..... 313/485

FOREIGN PATENT DOCUMENTS 0562679 9/1993 European Pat. Off. ..... H01J 61/09

*Primary Examiner*—Vip Patel
*Attorney, Agent, or Firm*—F. Brice Faller

[57] ABSTRACT

A discharge lamp is provided with a tubular discharge vessel having an internal diameter of at most 5 mm, with a luminescent screen, and with a filling which comprises mercury and a rare gas. The rare gas comprises more than 98 mole % neon, and the luminescent screen comprises a first group and a second group of luminescent substances, which first group comprises luminescent substances for converting UV radiation generated by mercury into visible light, and which second group comprises luminescent substances for converting the UV radiation generated by neon into visible light. The discharge lamp has a comparatively high luminous flux immediately after ignition even in cold surroundings.

10 Claims, 3 Drawing Sheets

DISCHARGE LAMP WITH SPECIFIC FILL AND LUMINESCENT LAYERS

BACKGROUND OF THE INVENTION

The invention relates to a discharge lamp provided with a tubular discharge vessel having an internal diameter of at most 5 mm, with a luminescent screen, and with a filling which comprises mercury and a rare gas.

Such a discharge lamp is known from EP 0562679 A1.

The rare gas used in the known discharge lamp usually consists mainly of argon. The known discharge lamp is highly suitable for use in a comparatively flat lighting unit on account of its small diameter. This increases the application possibilities of the discharge lamp considerably. Possible applications, for example, are the use of the discharge lamp in a lighting unit which serves as a backlight of an LCD screen or for the illumination of an instrument panel in an automobile. Other applications are in a lighting unit which forms a brake light or an indicator light of a vehicle. The flat shape of the lighting unit can be used in combination with widely differing shapes of the part of the vehicle on or in which the lighting unit is placed. A further advantage of such a discharge lamp is the comparatively high luminous efficacy (lm/W) during stationary lamp operation.

A major disadvantage of the known discharge lamp, however, is that the luminous flux of the discharge lamp immediately after ignition is comparatively low. This comparatively low luminous flux is caused by the fact that the quantity of mercury vapor present in the plasma immediately after ignition is considerably smaller than the quantity later during stationary lamp operation. It was found in practice that the initial luminous flux is lower in proportion as the internal diameter of the discharge vessel is smaller. The initial luminous flux of the lamp is also lower in proportion as the ambient temperature is lower. This comparatively low initial luminous flux renders the discharge lamp less suitable or even unsuitable for a large number of applications.

OBJECT AND SUMMARY OF THE INVENTION

It is an object of the invention to provide a discharge lamp which has a comparatively high luminous efficacy during stationary lamp operation and a comparatively high luminous flux immediately after ignition of the discharge lamp.

According to the invention, the rare gas comprises more than 98 mole % neon, and the luminescent screen comprises a first group and a second group of luminescent substances, which first group comprises luminescent substances for converting UV radiation generated by mercury into visible light, and which second group comprises luminescent substances for converting UV radiation generated by neon into visible light.

Immediately after ignition of the discharge lamp, the quantity of mercury present in the plasma is comparatively small, so that the quantity of long-wave UV radiation generated by mercury is also comparatively small. The neon present in the plasma, however, generates a comparatively large quantity of short-wave UV radiation immediately after ignition of the discharge lamp. The luminescent substances belonging to the second group convert the UV radiation generated by neon into visible light. Besides, the red light generated by the neon also contributes to the total quantity of visible light immediately after ignition of the discharge lamp. The initial luminous flux of the discharge lamp is comparatively high as a result of this. After ignition of the discharge lamp, the quantity of mercury in the plasma increases gradually until stationary lamp operation has established itself. During stationary lamp operation, substantially exclusively long-wave UV radiation is generated in the discharge by the mercury present in the discharge, whereas no or hardly any short-wave UV radiation or visible red light is generated any more by the neon.

The first and the second group of luminescent substances may comprise different luminescent substances. It is alternatively possible, however, the luminescent screen to comprise luminescent substances which belong both to the first and to the second group.

Good results were obtained with discharge lamps according to the invention wherein the luminescent screen comprises a first and a second luminescent layer, the first luminescent layer being provided on the wall of the discharge vessel and comprising luminescent substances belonging to the first group, and the second luminescent layer being provided on the first luminescent layer and comprising luminescent substances belonging to the second group. An important advantage of such an arrangement of the luminescent screen is that the first luminescent layer is often not excited by the UV radiation generated by neon because this radiation is almost entirely absorbed by the second luminescent layer. This renders it possible to use luminescent substances in the first luminescent layer which are comparatively quickly degraded under the influence of the UV radiation generated by neon. This considerably increases the number of luminescent substances which can be used in the first group. It was found in practice that, given a suitable choice of the layer thickness and composition of the second luminescent layer, both the initial luminous flux and also the color point of the light generated immediately after ignition of the discharge lamp can be favorably influenced. Since the short-wave UV radiation generated by neon is very strongly absorbed by the luminescent compounds in the second group of luminescent substances, the thickness of the second layer can be comparatively small. This has the result that only a minor part of the UV radiation generated by mercury is absorbed by the second layer during stationary operating conditions, so that the discharge lamp has a comparatively high luminous efficacy. In a preferred embodiment, the layer thickness of the second luminescent layer is smaller than 5 $\mu$m.

Degradation of luminescent substances belonging to the first group is also counteracted in discharge lamps according to the invention wherein the first group of luminescent substances is contained in luminescent grains, and the second group of luminescent substances forms part of a layer which is provided on the surface of said luminescent grains.

It is noted that a certain quantity of blue light is also generated under stationary operating conditions owing to the presence of mercury in the discharge lamp. Depending on the desired color of the visible light generated by the discharge lamp during stationary operation, it may be necessary to remove this blue light by means of an optical filter.

Discharge lamps according to the invention which generate red light may be obtained when both the first and the second group of luminescent substances comprise a red-luminescing compound. It is also possible for one red-luminescing compound to be chosen such that it forms part of both the first and the second group of luminescent substances. An example of such a red-luminescing compound is yttrium oxide activated by trivalent europium. The red-luminescing compound is excited both by the UV radiation generated by mercury and by the UV radiation generated by neon in discharge lamps which generate red light and in which the luminescent screen comprises such a red-luminescing compound. Such a discharge lamp generates red light which, immediately after ignition of the discharge lamp, consists of the red light generated directly by the neon in the plasma and of the red light which is generated via the UV radiation generated by the neon and the red-luminescing compound. This initial luminous flux is comparatively high. During stationary lamp operation, the discharge lamp also generates red light, this time generated via the UV radiation originating m the mercury and the red-luminescing compound. A discharge lamp according to this first embodiment is highly suitable for use, for example, in a lighting unit which serves as a brake light of a vehicle on account of the comparatively high luminous flux both immediately after ignition and during stationary lamp operation. These discharge lamps according to the invention which generate red light are preferably provided with filters for removing the blue light generated by the mercury.

Discharge lamps according to the invention which generate amber light or white light may be obtained in that the first group of luminescent substances comprises a red-luminescing compound and a first green-luminescing compound, and the second group of luminescent substances comprises a second green-luminescing compound. If the luminescent screen of the discharge lamp is built up from two layers, as indicated above, the first layer comprises the red-luminescing and the first green-luminescing compound, and the second layer comprises the second green-luminescing compound. Immediately after ignition, substantially exclusively the second layer is excited by the UV radiation generated by the neon, and the visible light is formed by the red light generated in the discharge by the neon and the green light generated by way of the second layer. Given a suitable choice of the thickness of the second layer, substantially no UV radiation generated by mercury will be absorbed by the second layer during stationary operation. This UV radiation generated by mercury is absorbed almost exclusively by the first layer. This first layer generates both green and red light during stationary lamp operation, by way of the red-luminescing compound and the first green-luminescing compound. If the luminescent screen of the discharge lamp comprises only one luminescent layer, however, the luminescent screen is capable of functioning with only one green-luminescing compound, which also serves as the first green-luminescing compound, so that it comprises only a single green-luminescing compound which belongs both to the first and to the second group of luminescent substances. Red light is directly generated by neon in the discharge radiation immediately after ignition of the discharge lamp. If the red-luminescing compound is chosen such that it also belongs both to the first and to the second group of luminescent substances, red light is also generated immediately after ignition of the discharge lamp via the red-luminescing compound. Green light is generated at the same time via the UV radiation generated by neon and the green-luminescing compound. During stationary lamp operation, red and green light are generated via the red-luminescing compound and the green-luminescing compound in conjunction with the UV radiation generated by mercury. The discharge lamp according to this embodiment will efficiently generate light of amber color both immediately after ignition and under stationary operating conditions, provided it is fitted with a filter which removes blue light. If the discharge lamp is not fitted with a filter which removes blue light, this blue light together with the red and green light generated by the luminescent screen is capable of forming white light, given a suitably chosen composition of the luminescent screen. Since the green-luminescing compound present in the luminescent screen is excited by the UV radiation generated by neon, while red light is also directly generated by the neon, the luminous flux of the discharge lamp is comparatively high immediately after ignition. Such an amber discharge lamp is highly suitable, for example, for use in a lighting unit which serves as a direction indicator of a vehicle on account of the comparatively high luminous flux both immediately after ignition and during stationary lamp operation. If white light is generated during stationary lamp operation, such a discharge lamp is highly suitable for use, for example, in a lighting unit which serves as a reversing light of a vehicle. Such a discharge lamp is also highly suitable for instrument panel lighting or interior lighting of an automobile.

Good results were obtained especially with discharge lamps in which yttrium oxide activated by trivalent europium or pentaborate comprising gadolinium and magnesium and activated by bivalent manganese is used as the red-luminescing compound. Yttrium oxide activated by trivalent europium belongs both to the first and to the second group of luminescent substances. Pentaborate comprising gadolinium and magnesium and activated by bivalent manganese belongs exclusively to the first group of luminescent substances. Good results were also obtained with discharge lamps comprising one or several from the group of compounds formed by willemite and yttrium-aluminum garnet activated by trivalent cerium, in which part of the aluminum may be replaced by gallium, as the green-luminescing compound. These green-luminescing compounds belong both to the first and to the second group of luminescent substances.

DESCRIPTION OF THE PREFERRED EMBODIMENT

Figure 1:
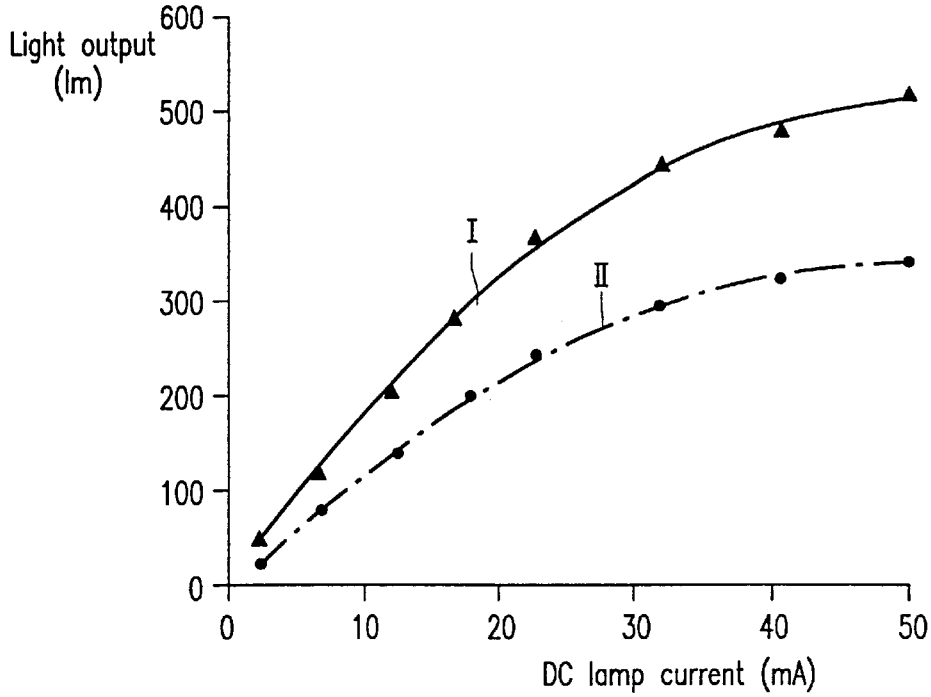
FIG. 1 shows the initial and the stationary luminous flux of a red discharge lamp according to the invention as a function of the direct current with which the discharge lamp is supplied.

The data shown in FIG. 1 were measured for a discharge lamp having a tubular discharge vessel with a length of approximately 40 cm and an internal diameter of 2.5 mm. The discharge lamp was filled with neon (filling pressure 5 mbar) and mercury (5 mg). The wall of the discharge vessel was coated with a luminescent screen consisting of yttrium oxide activated by trivalent europium. The coating weight was 2.5 mg/cm$^2$. This luminescent screen converts both the short-wave UV radiation generated by neon and the UV radiation generated by mercury into red light. A blue-absorbing filter was also provided on the wall of the discharge vessel. This filter was a low-pass filter having a transmission half-value of 495 nm. The blue light generated by mercury during stationary operation is absorbed by the filter, so that the light generated by the discharge lamp is red also during stationary lamp operation. The luminous flux of the discharge lamp is plotted on the vertical axis in lumens in FIG. 1. The direct current with which the discharge lamp is supplied is plotted on the horizontal axis in mA. Curve I in FIG. 1 represents the luminous flux of the discharge lamp immediately after ignition at an ambient temperature of approximately −20° C. Curve II is the luminous flux of the discharge lamp at the same ambient temperature during stationary lamp operation. It is apparent that the luminous flux immediately after ignition is even higher than that obtaining during stationary operation. This is caused by the fact that only very little mercury is present in the discharge immediately after ignition, so that the operating voltage of the discharge lamp is comparatively high, with the result that the discharge lamp dissipates a higher power immediately after ignition than during subsequent stationary operation, given a certain value for the direct current. The luminous efficacy of the discharge lamp, however, is considerably higher during stationary operation. If argon or a mixture of argon and neon is used as a filling gas in such a discharge lamp instead of neon, the initial luminous flux immediately after ignition of the discharge lamp will be only approximately 5% of the luminous flux during stationary operation.

Figure 2:
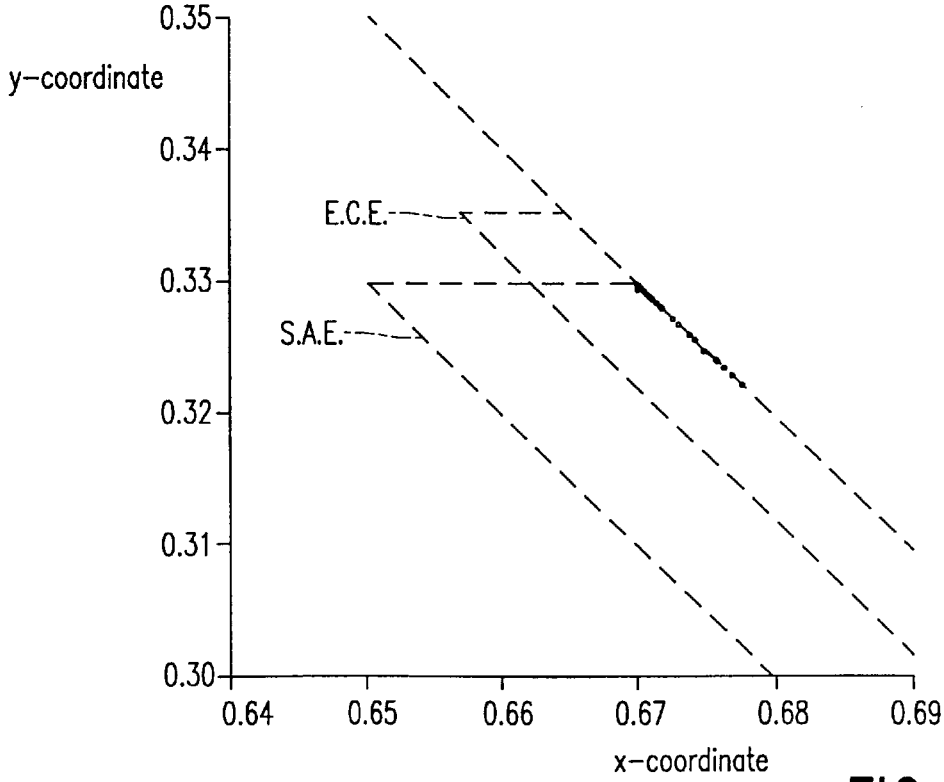
FIG. 2 shows the drift of the color point of the light generated by a red discharge lamp according to the invention as a function of time during the first minute after ignition of the discharge lamp.

In FIG. 2, the y-coordinate of the color point of the light generated by a discharge lamp is plotted on the vertical axis. The x-coordinate of the color point of the light generated by a discharge lamp is plotted on the horizontal axis. The data shown in FIG. 2 were measured for a red discharge lamp provided with a low-pass filter having a transmission half-value of 495 nm for the removal of blue light. The discharge lamp had the same length and the same diameter as the discharge lamp whose data were shown in FIG. 1 The filling of this red discharge lamp was also the same as the filling of the discharge lamp whose data were given in FIG. 1. The wall of the red discharge lamp was coated with a mixture of 25% by weight of magnesium germanate and 75% by weight of yttrium oxide activated by trivalent europium. The coating weight was 2.5 mg/cm$^2$. The region of the color triangle within which the color point of the light of red automobile signaling lights must lie in order to comply with the United States S.A.E. standard is indicated with a broken line in FIG. 2. The region within which the light of a red discharge lamp for use in motorcar signaling lights must lie in order to comply with the European E.C.E. standard is indicated in the same manner in FIG. 2. In addition, FIG. 2 shows the drift of the color point of the discharge lamp during the first 60 seconds immediately after ignition at an ambient temperature of −20° C. and for a direct current through the lamp of 10 mA. The color point having the lowest x-coordinate and the highest y-coordinate shown in FIG. 2 is the color point of the light generated by the discharge lamp immediately after ignition. The other color points shown are the color points of the light generated by the discharge lamp at moments after ignition, the time interval between two consecutive points being two seconds each time. It is evident that the x coordinate of the color point increases while the y-coordinate decreases.

As was stated above, yttrium oxide activated by trivalent europium can be excited both by means of UV radiation generated by neon and by means of UV radiation generated by mercury. The color point of the red light generated by yttrium oxide activated by trivalent europium has an x-coordinate of 0.643 and a y-coordinate of 0.357. Magnesium germanate, however, can only be excited by means of UV radiation generated by mercury and generates red light having a color point whose x-coordinate is 0.713 and whose y-coordinate is 0.287. The color point of the red light generated directly by neon immediately after ignition of the discharge lamp has an x-coordinate of 0.666 and a y-coordinate of 0.332. Immediately after ignition of the discharge lamp, the red light is generated both directly in the plasma by neon and via the UV radiation generated by the neon and the yttrium oxide activated by trivalent europium. The red light is generated during stationary lamp operation via the UV radiation generated by mercury both by means of the yttrium oxide activated by trivalent europium and by means of the magnesium germanate. The color point of the red light generated by magnesium germanate has a higher x-value and a lower y-value than the red light generated by means of the yttrium oxide activated by trivalent europium, as has the color point of the red light generated directly by neon. This is why the red light generated by the discharge lamp also has a color point with a higher value for the x-coordinate and a lower value for the y-coordinate than would be the case if the red light were exclusively generated by yttrium oxide activated by trivalent europium both immediately after ignition and during stationary lamp operation. As a result of this, all color points shown in FIG. 2 lie within the region within which the light of a red discharge lamp for use in automobile signaling lights must lie according to the European E.C.E. standard or the United States S.A.E. standard.

Figure 3:
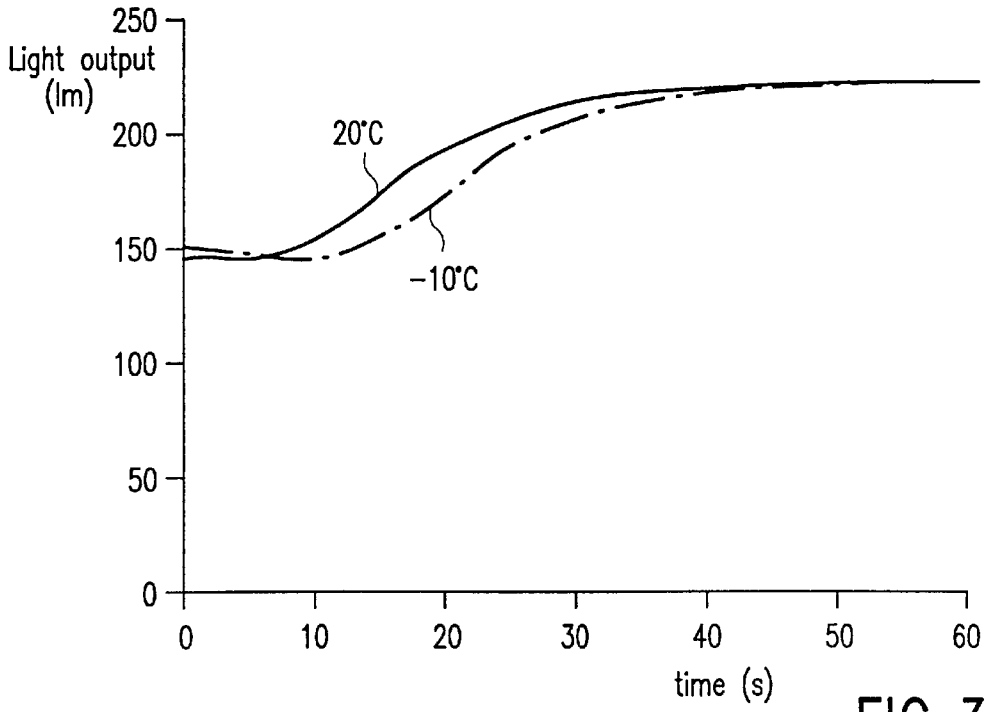
FIG. 3 shows the luminous flux of an amber discharge lamp according to the invention as a function of time immediately after ignition of the discharge lamp at an ambient temperature of −10° C. and at an ambient temperature of 20° C.

The data shown in FIG. 3 were also measured for a discharge lamp having a tubular discharge vessel with a length of approximately 40 cm and an internal diameter of 2.5 mm. The discharge lamp was provided with a low-pass filter with a transmission half-value of 495 nm. The discharge lamp was filled with neon (filling pressure 15 mbar) and mercury (5 mg). The wall of the discharge vessel was coated with a luminescent screen comprising a mixture of 40% by weight of yttrium oxide activated by trivalent europium and 60% by weight of yttrium-aluminum garnet activated by trivalent cerium. The coating weight was 2.5 mg/cm$^2$. The lamp current was 10 mA DC. As was stated above, the yttrium oxide activated by trivalent europium converts both the short-wave UV radiation generated by neon and the UV radiation generated by mercury into red light. The yttrium-aluminum garnet activated by trivalent cerium converts both the short-wave UV radiation generated by neon and the UV radiation generated by mercury into green light. For these reasons, the light radiated by the lamp has an amber color both immediately after ignition and during stationary lamp operation. In FIG. 3, the time is plotted in seconds on the horizontal axis, and the luminous flux in lumens on the vertical axis. FIG. 3 shows the luminous flux of the lamp during the first 60 seconds after ignition at an ambient temperature of −10° C. and at an ambient temperature of 20° C. If argon or a mixture of argon and neon is used as the filling gas in such a discharge lamp instead of neon, the initial luminous flux immediately after ignition of the discharge lamp is no more than approximately 5% of the luminous flux during stationary operation. FIG. 3 shows that in an amber lamp according to the invention the initial luminous flux is comparatively high, also in the case of a comparatively low ambient temperature.

Figure 4:
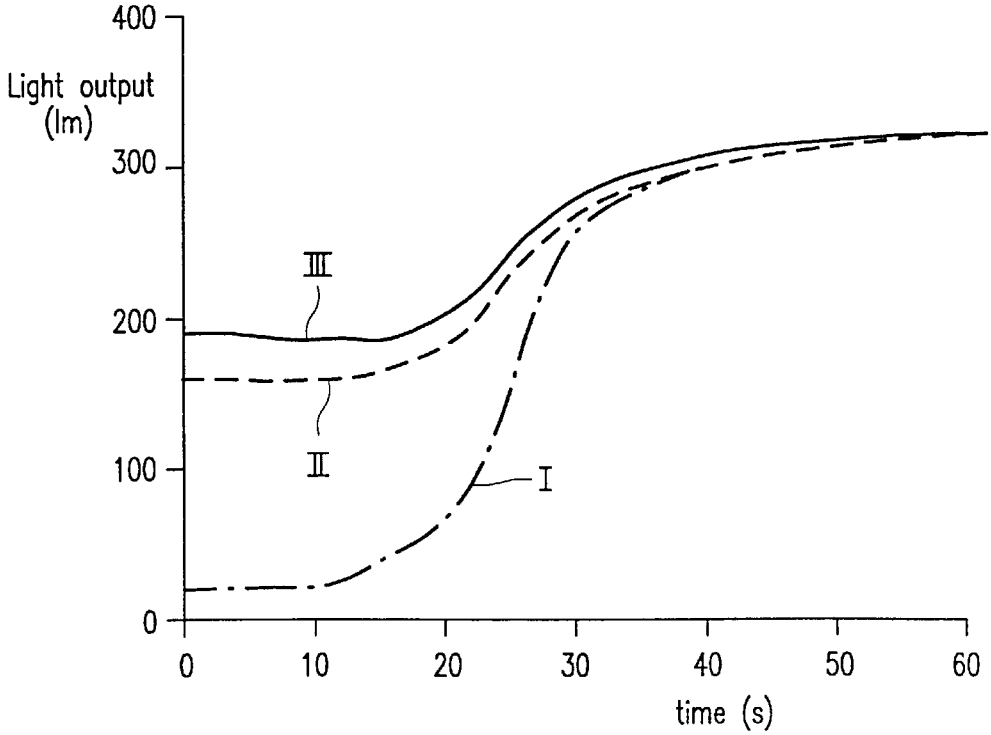
FIG. 4 shows the luminous flux values of three discharge lamps which generate white light during stationary operation as a function of time during the first minute after ignition of the discharge lamps.
Figure 5:
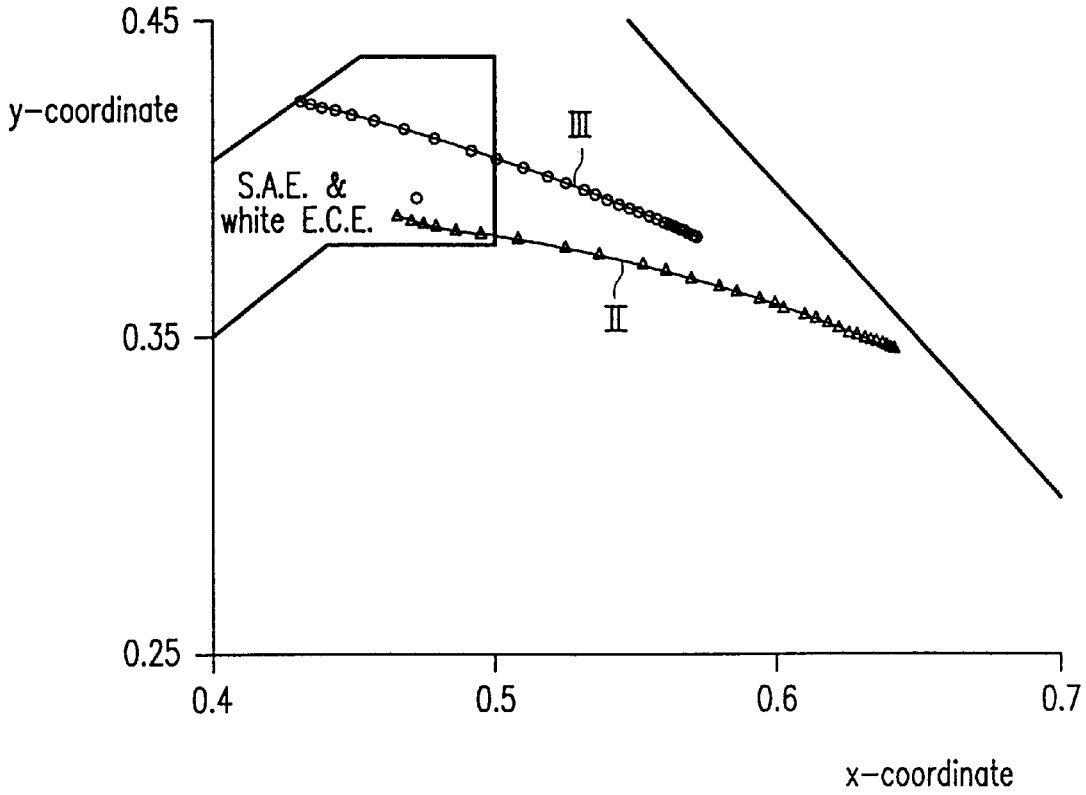
FIG. 5 shows the drift of the color point of two of the above three discharge lamps, again as a function of time and during the first minute after ignition of the discharge lamps.

The data shown in FIG. 4 and FIG. 5 were measured for three discharge lamps having a tubular discharge vessel of approximately 40 cm length and an internal diameter of 2.5 μm. The first discharge lamp was filled with a mixture of neon (90 mole %) and argon (10 mole %) (filling pressure 25 mbar) and also with mercury (5 mg). The second and the third discharge lamp were filled with neon (filling pressure 15 mbar) and mercury (5 mg). The luminescent screen of both the first and the second discharge lamp consisted of a mixture of 25% by weight of cerium-magnesium aluminate activated by trivalent terbium and 75% by weight of yttrium oxide activated by trivalent europium. The coating weight was 2.5 mg/cm$^2$. The luminescent screen of the third discharge lamp consisted of two layers. The first layer, which was provided on the wall of the lamp vessel, corresponded to the layer of the first and the second discharge lamp. The second layer consisted of a luminescent compound having the formula $Y_{3-x}Al_{2.5}Ga_{2.5}O_{12}:xCe^{3+}$. The coating weight of this second layer was 0.24 mg/cm$^2$, which corresponds approximately to an average layer thickness of 0.5 μm. The lamps were supplied with a direct current of 10 mA. Each of the three discharge lamps generates white light during stationary operation, composed of red light, blue light, and green light. The red light is generated by means of the yttrium oxide activated by trivalent europium. The blue light is directly generated by the mercury. The green light is generated by means of the cerium-magnesium aluminate activated by trivalent terbium. In FIG. 4, the luminous flux is plotted in lumens on the vertical axis and the time in seconds on the horizontal axis. The curves I, II and III show the luminous fluxes of the first, the second, and the third discharge lamp, respectively, immediately after ignition as a function of time at an ambient temperature of −20° C. It is apparent that the luminous flux of the first discharge lamp is very low immediately after ignition and also remains so for a comparatively long time. This is caused by the fact that no short-wave UV radiation is generated in the plasma of this lamp, while in addition the plasma contains only very little mercury immediately after ignition, so that only a small quantity of visible light is generated by way of the luminescent screen. In addition, no red light is generated directly by neon in the plasma of the first discharge lamp. The second and the third discharge lamp have a comparatively high luminous flux immediately after ignition thanks to the excitation of the luminescent screen by the short-wave UV radiation generated by neon. Of the two luminescent compounds present in the luminescent screen of the second discharge lamp, however, it is only the yttrium oxide activated by trivalent europium which is excited by the short-wave UV radiation generated by neon. This has the result that almost exclusively red light is generated immediately after lamp ignition, both directly by neon and indirectly by the yttrium oxide activated by trivalent europium. The color of the light radiated by the second discharge lamp in this case gradually changes from red to white. This red color of the light immediately after ignition is highly undesirable in many applications. In the third discharge lamp, green light is generated immediately after ignition of the discharge lamp in that the second layer is excited by the short-wave UV radiation generated by neon. This short-wave UV radiation is absorbed so strongly by the second layer that the luminescent compounds in the first layer are not or substantially not excited. For this reason, the red light is almost exclusively generated directly by neon immediately after ignition of the discharge lamp. Owing to this red light and this green light, the color of the light generated by the third discharge lamp immediately after ignition is a pale pink. Then the color of the light radiated by the discharge lamp changes gradually from pale pink to white. The pale pink color of the light generated by the third discharge lamp immediately after its ignition renders the third discharge lamp considerably more useful in a large number of applications than the second discharge lamp.

In FIG. 5, the y coordinate of the color point of the light generated by a discharge lamp is plotted on the vertical axis. The x-coordinate of the color point of the light generated by a discharge lamp is plotted on the horizontal axis. FIG. 5 also indicates the region within which the color point of white automobile signaling lights must lie, both according to the United States S.A.E. standard and the European E.C.E. standard. Curves II and III represent the drift of the color points of the second and the third discharge lamp, respectively, during the first 60 seconds immediately after ignition at an ambient temperature of −20° C. The points of the two curves having the highest value for the x-coordinate are the color points of the light generated by the relevant lamps immediately after ignition. The other points of the two curves indicate the color points of the light generated by the discharge lamp at later moments after ignition, the time interval between two consecutive points being two seconds each time. It can be seen that the color point of the third discharge lamp immediately after ignition lies considerably less far removed from the region within which the color point of white signaling lamps should lie according to the S.A.E. standard and E.C.E. standard than does the color point of the second discharge lamp. It is also apparent that the color point of the third discharge lamp reaches the white region considerably more quickly than does the color point of the second discharge lamp.

We claim:

1. A discharge lamp provided with a tubular discharge vessel having an internal diameter of at most 5 mm, with a luminescent screen, and with a filling which comprises mercury and a rare gas, characterized in that the rare gas comprises more than 98 mole % neon, and in that the luminescent screen comprises a first group and a second group of luminescent substances, which first group comprises luminescent substances for converting UV radiation generated by mercury into visible light, and which second group comprises luminescent substances for converting UV radiation generated by neon into visible light.

2. A discharge lamp as claimed in claim 1, wherein the luminescent screen comprises a first and a second luminescent layer, said first luminescent layer being provided on the wall of the discharge vessel and comprising luminescent substances belonging to the first group, and said second luminescent layer being provided on the first luminescent layer and comprising luminescent substances belonging to the second group.

3. A discharge lamp as claimed in claim 2, wherein the average layer thickness of the second luminescent layer is smaller than 5 μm.

4. A discharge lamp as claimed in claim 1, wherein the first group of luminescent substances is contained in luminescent grains, and the second group of luminescent substances forms part of a layer which is provided on the surface of said luminescent grains.

5. A discharge lamp as claimed in claim 1, wherein both the first and the second group of luminescent substances comprise a red-luminescing compound.

6. A discharge lamp as claimed in claim 5, wherein the luminescent screen comprises a red-luminescing compound which forms part of both the first and the second group of luminescent substances.

7. A discharge lamp as claimed in claim 5, wherein the luminescent screen comprises yttrium oxide activated by trivalent europium.

8. A discharge lamp as claimed in claim 1, wherein the first group of luminescent substances comprises a red-luminescing compound and a first green-luminescing compound, and the second group of luminescent substances comprises a second green-luminescing compound.

9. A discharge lamp as claimed in claim 8, wherein the red-luminescing compound comprises one of the compounds from the group formed by yttrium oxide activated by trivalent europium and pentaborates comprising gadolinium and magnesium and activated by bivalent manganese, and the second green-luminescing compound comprises one or several of the compounds from the group formed by willemite and yttrium-aluminum garnet activated by trivalent cerium, in which part of the aluminum may be replaced by gallium.

10. A discharge lamp as claimed in claim 1 further comprising optical filter.

* * * * *